US006468072B2

(12) United States Patent
Shook

(10) Patent No.: US 6,468,072 B2
(45) Date of Patent: Oct. 22, 2002

(54) WIND GUARD FOR OPEN FLAME GAS LANTERN

(75) Inventor: William Boyce Shook, Brandon, MS (US)

(73) Assignee: Legendary Lighting, L.L.C., Jackson, MS (US)

( * ) Notice: Subject to any disclaimer, the term of this patent is extended or adjusted under 35 U.S.C. 154(b) by 0 days.

(21) Appl. No.: 09/735,414

(22) Filed: Dec. 11, 2000

(65) Prior Publication Data

US 2002/0072023 A1 Jun. 13, 2002

(51) Int. Cl.[7] ..... F21V 37/02
(52) U.S. Cl. ..... 431/350; 362/180
(58) Field of Search ..... 431/111, 310, 431/350; 362/171, 173, 180, 182, 312, 363, 376, 415

(56) References Cited

U.S. PATENT DOCUMENTS

| | | | | |
|---|---|---|---|---|
| 107,884 A | * | 10/1870 | Cuppers | 362/312 |
| 404,830 A | * | 6/1889 | Folmer | 431/350 |
| 2,263,659 A | | 11/1941 | Tullis | |
| 3,493,312 A | | 2/1970 | Guenin et al. | 431/122 |
| 3,529,911 A | | 9/1970 | Townsend | 431/107 |
| 3,773,458 A | | 11/1973 | Spotts | 431/156 |
| 4,131,414 A | | 12/1978 | Curtis | 431/104 |
| 4,599,683 A | | 7/1986 | Beckham et al. | 362/166 |
| 5,533,892 A | | 7/1996 | Long | 431/264 |
| 6,042,366 A | | 3/2000 | Long et al. | 431/142 |

FOREIGN PATENT DOCUMENTS

| | | | | |
|---|---|---|---|---|
| GB | 150456 | * | 9/1920 | 362/171 |

* cited by examiner

*Primary Examiner*—Sara Clarke
(74) *Attorney, Agent, or Firm*—Knobbe, Martens, Olson & Bear, LLP

(57) ABSTRACT

A device for preventing extinguishment of a free standing flame joined at a burner tip at the upper end of a gas supply pipe in a gas lantern comprising a tubular sleeve installed around the gas supply pipe to form an air supply channel. The upper end of the tubular sleeve is coterminous with the upper end of the gas supply pipe.

18 Claims, 2 Drawing Sheets

WIND GUARD FOR OPEN FLAME GAS LANTERN

BACKGROUND OF THE INVENTION

In an open flame gas lantern, a free-standing flame is provided from a burner tip at the upper end of a burner stem or gas supply pipe. The elongated burner stem extends substantially vertically in a lantern housing which includes a globe surrounding the stem and burner tip, to prevent the flame from being blown out by a breeze or wind. The globe, typically a glass cylinder, is open at its upper and lower ends to provide proper ventilation required to vent the heat and gases from the interior chamber of the globe. Although the globe is intended to protect the flame from windy conditions, the flame is often extinguished, not by being literally "blown out" by direct action of the wind, but instead suffocated from lack of sufficient oxygen to support combustion of the gas. Wind passing across the exterior of the lantern housing and globe interferes with the lantern's ability to properly draft air into the interior chamber of the globe, thus depriving the flame of adequate oxygen. The present invention comprises a flame guard to avoid and prevent extinguished flame commonly caused by wind.

SUMMARY OF THE INVENTION

The present invention is directed to a flame guard device comprising an elongated tubular sleeve installed in a gas lantern for producing a free-standing flame. The sleeve is mounted coaxially around the burner stem below the free-standing flame to provide adequate oxygen delivered to the burner tip to support combustion of the flame.

DETAILED DESCRIPTION OF THE PREFERRED EMBODIMENT

Figure 1:
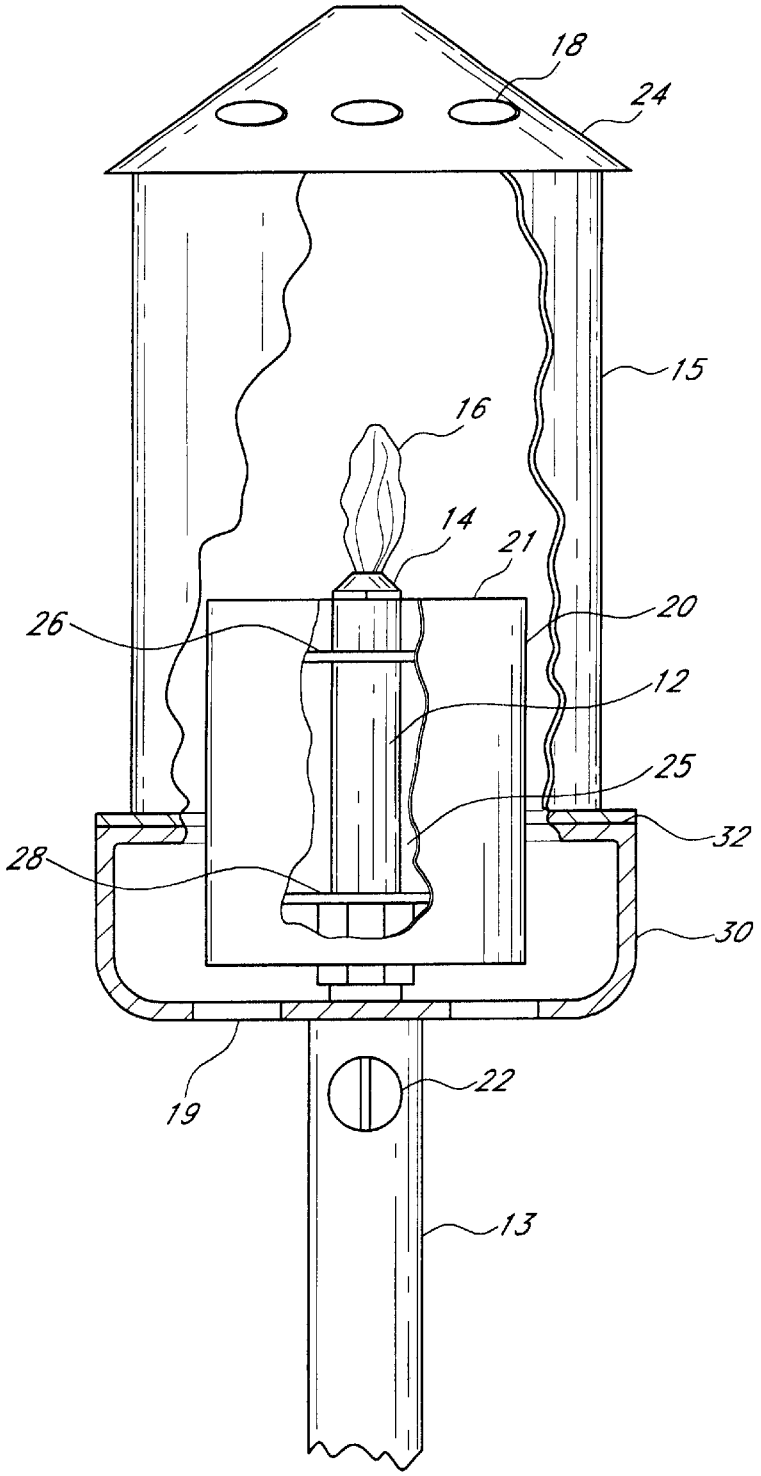
FIG. 1 is a side view of a gas lantern assembly, partly cut away, to show the installed wind guard device of the present invention.

FIG. 1 shows a gas lantern assembly with the wind guard device of the invention installed. The gas lantern comprises a frame assembly or housing 11 installed on a pipe or stand 13 through which a gas supply conduit (not shown) extends. The gas supply conduit is connected to a gas supply source, typically propane or natural gas. A valve 22 is used to which regulate the gas flow from the gas supply conduit. The gas supply conduit directs gas to burner stem 12 which extends substantially vertically in the gas lantern assembly with a burner tip 14 secured at the upper end of the burner stem 12. Thus, the burner stem supplies gas from valve 22 to the burner tip 14. Such components and equivalent devices for supplying gas to a burner tip 14 in a lantern are well known in the art.

Other components of the gas lantern assembly include a globe 15, commonly a glass cylinder open at its upper and lower ends and supported and annular support member 32 on a frame member 30. The frame member may comprise be arms or rod, or a plate having sufficient openings to provide suitable ventilation at the bottom of the lantern assembly. At the top of the lantern is a cover 24 having one or more ventilation ports 18. The cover may be secured directly to an upper edge of globe 15 or it may be supported by suitable support members 30 which will form a part of the frame member or housing assembly. The size, shape and position of the cover is not critical since its purpose is to direct water (rain) away from the flame.

The wind guard of the invention comprises a cylinder or tubular sleeve 20 secured on burner stem 12 and separated therefrom to form an air supply channel 25. The tubular sleeve 20 is open at its upper and lower ends to provide adequate ventilation flow from the bottom ventilation port or ports 19, which are open and exposed to atmospheric air whereby oxygen-containing air is supplied through the bottom ventilation port or ports, and upwardly along the air supply channel 25 to the open upper end of the tubular sleeve 20. Such an arrangement of components provides substantial ventilation through air supply channel 25 which acts as a ventilating chamber to draw and direct a proper air/gas mixture to the flame 16. The resulting flame is referred to as a free-standing flame and is formed by burner tip 14. When the flame is ignited, atmospheric air is drawn by convection through the bottom ventilation port or ports 19, along the ventilating chamber provided by air supply channel 25, along the interior of tubular sleeve 20, and therefrom to the burner tip to support combustion of the gas/air mixture. The gases of combustion are then directed upwardly through the upper portion of the interior of globe 15 and are vented to atmosphere via ventilation port or ports 18 at the top of the gas lantern assembly.

Figure 2:
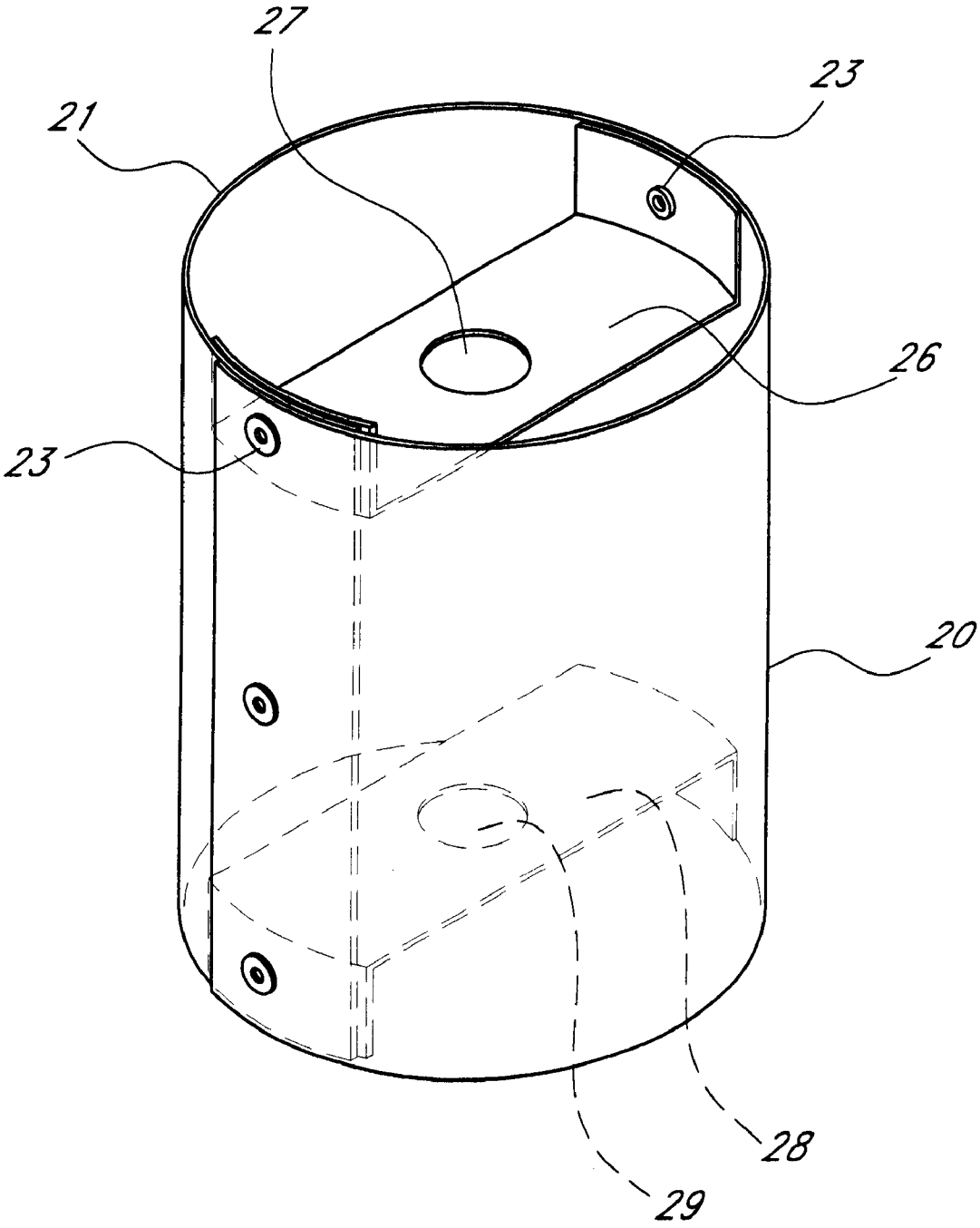
FIG. 2 is another view of the wind guard of the invention illustrating support members and other features of the device.

Also referring to FIG. 2, the wind guard of the invention comprises a cylinder or tubular sleeve 20, preferably cylindrical and substantially uniform along its length. Brackets are conveniently used as support members for securing the tubular sleeve in proper alignment along burner stem 12 as illustrated in FIG. 1. As shown, an upper bracket 26 and lower bracket 28 are each secured on opposite interior surfaces of the tubular sleeve and which brackets are provided with orifices 27 and 29, respectively, of suitable size for installing the device on the burner stem. The orifices are preferably the same shape and at least slightly larger than the outer surface of the burner stem. However, the brackets are only illustrative of the types of support devices that can be used to secure and support the cylindrical flame guard on the burner stem. For example, one or more clips, rods or other bracket shapes and forms secured or attached to the flame guard cylinder may be used. Moreover, the method of attaching such support members is not critical, and rivets, welds, etc. well known in the art may be used. Rivets 23 are shown in FIG. 2.

The diameter of the flame guard cylinder (tubular sleeve) relative to the burner stem must be sufficient to provide adequate ventilation via air supply channel 25. Preferably the inner diameter of the sleeve is at least about two times greater than the outer diameter of the burner stem (gas supply pipe) and more preferably at least about three times. Generally, the ratio of the inner diameter of the sleeve:outer diameter of the gas supply pipe is between about 2:1 and about 10:1, and more preferably between about 3:1 and about 5:1.

The positioning of the tubular sleeve 20 relative to the burner stem 12 and burner tip 14 is important. The burner stem and tubular sleeve are preferably coaxial, with the air supply channel 25 being substantially uniform along the length of the two components in order to provide a uniform air supply around the perimeter of the flame. It is also important that the upper edge or end 21 is substantially or approximately level with the top of burner stem 12 and below the burner tip 14. In other words, the tubular sleeve

20 should be secured on the burner stem 12 so that the upper edge 21 of the sleeve does not extend above the burner tip 14. Moreover, the tubular sleeve must be of sufficient length so that it extends to the burner tip. Thus, the length of the device will depend on the size and design of the lantern in which it is to be installed.

The wind guard cylinder is easy to install. With the flame on the gas lantern extinguished, the cylinder. is placed over the burner stem with the top and bottom brackets holding the cylinder above the floor base of the housing so as to permit air to enter the cylinder from below. The installation of the product eliminates the expense and frustration associated with repeated relighting of gas lanterns when the flame is suffocated or otherwise extinguished in windy conditions. These as well as other advantages and features of the device of the invention will be evident to those skilled in the art.

What is claimed is:

1. A gas lantern assembly comprising:

a generally vertical burner stem having an upper end and a burner tip secured to the upper end thereof for producing a free-standing flame;

a valve for supplying gas to the burner stem;

a housing including a globe enclosing a chamber and a frame for supporting the globe the housing having one or more ventilation ports communicating with the surrounding atmosphere and providing for passage of air into and out of the chamber; and a generally cylindrical tubular sleeve secured within the chamber around the burner stem and coaxial therewith and spaced apart therefrom to form an air channel therebetween, said sleeve open at its upper and lower ends, said upper end being substantially coterminous with the upper end of the burner stem.

2. A gas lantern assembly of claim 1 wherein said sleeve is mounted on said burner stem.

3. A gas lantern assembly of claim 1 or 2 wherein said sleeve includes one or more support members for securing said sleeve on said burner stem.

4. A gas lantern assembly of claim 3 wherein at least one of said one or more support members comprises a bracket extending from an interior sleeve wall.

5. A gas lantern assembly of claim 3 wherein said one or more support members includes a slot therein for receiving said burner stem.

6. A gas lantern assembly of claim 4 wherein said sleeve is substantially uniformly spaced apart from said burner stem along its length to form an annular air channel there between.

7. A gas lantern assembly of claim 5 wherein said one or more support members is secured to opposite sides of an interior sleeve wall.

8. A gas lantern assembly of claim 1 wherein the inner diameter of said sleeve is at least two times the outer diameter of said burner stem.

9. A gas lantern assembly of claim 1 wherein the inner diameter of said sleeve is at least three times the outer diameter of said burner stem.

10. A gas lantern assembly of claim 1 wherein the ratio of the inner diameter of said sleeve:outer diameter of said burner stem is between about 2:1 and about 10:1.

11. A gas lantern assembly of claim 1 wherein the ratio of the inner diameter of said sleeve outer diameter of said burner stem is between about 3:1 and about 5:1.

12. A gas lantern assembly comprising:

a as flame producing assembly comprising a gas supply pipe having an upper end and a burner tip for producing a flame at the upper end thereof and a gas supply source communicating at the lower end;

a generally cylindrical tubular member extending around the gas supply pipe and generally coaxcially therewith and spaced apart therefrom to form a generally annular air supply channel therebetween, said tubular member open at upper and lower ends, said upper end being substantially coterminous with the upper end of the gas supply pipe; and a globe cited to atmosphere for enclosing said gas supply pipe, burner tip and tubular member.

13. An assembly of claim 12 including a valve for opening and closing communication between said gas supply source and said gas supply pipe.

14. In a method of operating a gas lantern comprising a gas supply pipe having an upper end and having a burner tip at the upper end for producing a flame at its upper end, and a housing assembly including a globe supported around said burner tip and forming a vented chamber for said flame:

a method of preventing extinguishment of said flame caused by wind outside of said housing assembly comprising:

securing a generally cylindrical tubular member, having an open upper end and an open lower end, coaxcially around said gas supply pipe and spaced apart therefrom to form an air supply channel therebetween and securing said tubular member relative to said gas supply pipe such that the upper end of said tubular member is substantially coterminous with the upper end of said gas supply pipe and exposing the lower end of said tubular member to atmospheric air, and whereby atmospheric air in said chamber is directed along said air supply channel from the lower end of said tubular member to the upper end thereof for supporting combustion of gas at said burner tip.

15. A gas lantern assembly comprising:

a generally vertical burner stem and a burner tip secured to the upper end thereof for producing a free-standing flame;

a valve for supplying gas to the burner stem;

a housing including a globe enclosing a chamber and a frame for supporting the globe, the housing having one or more ventilation ports communicating with the surrounding atmosphere and providing for passage of air into and out of the chamber; and a tubular sleeve secured within the chamber around the burner stem and spaced apart therefrom to form an air channel therebetween and wherein the inner diameter of said sleeve is at least two times the other diameter of said gas supply pipe, said sleeve open at its upper and lower ends, said upper end being substantially coterminous with the upper end of the burner stem.

16. A gas lantern assembly of claim 15 wherein the inner diameter of said sleeve is at least three times the outer diameter of said gas supply pipe.

17. A gas lantern assembly of claim 15 wherein the ratio of the inner diameter of said sleeve:outer diameter of said gas supply pipe is between about 2:1 and about 10:1.

18. A gas lantern assembly of claim 15 wherein the ratio of the inner diameter of said sleeve:outer diameter of said gas supply pipe is between about 3:1 and about 5:1.

* * * * *